US011441303B2

(12) United States Patent
Oberholzer

(10) Patent No.: US 11,441,303 B2
(45) Date of Patent: Sep. 13, 2022

(54) SIPHON

(71) Applicant: GEBERIT INTERNATIONAL AG, Jona (CH)

(72) Inventor: Marco Oberholzer, Eschenbach (CH)

(73) Assignee: GEBERIT INTERNATIONAL AG, Jona (CH)

( * ) Notice: Subject to any disclaimer, the term of this patent is extended or adjusted under 35 U.S.C. 154(b) by 103 days.

(21) Appl. No.: 17/042,693

(22) PCT Filed: Mar. 28, 2019

(86) PCT No.: PCT/EP2019/057889
§ 371 (c)(1),
(2) Date: Sep. 28, 2020

(87) PCT Pub. No.: WO2019/185813
PCT Pub. Date: Oct. 3, 2019

(65) Prior Publication Data

US 2021/0123223 A1 Apr. 29, 2021

(30) Foreign Application Priority Data

Mar. 29, 2018 (EP) ..... 18164983

(51) Int. Cl.
*E03C 1/284* (2006.01)

(52) U.S. Cl.
CPC ..... *E03C 1/284* (2013.01)

(58) Field of Classification Search
CPC ..... E03C 1/284
(Continued)

(56) References Cited

U.S. PATENT DOCUMENTS 427,546 A * 5/1890 Bowerman ..... E03C 1/284 137/247.13
784,849 A * 3/1905 Fuqua ..... E03C 1/284 137/625.22

(Continued)

FOREIGN PATENT DOCUMENTS

DE 20 2009 004 764 U1 10/2010
EP 1 447 486 A2 8/2004

(Continued)

OTHER PUBLICATIONS

English Translation of Chinese Search Report dated Apr. 14, 2021 from the China National Intellectual Property Administration in CN Application No. 2019800231558.

(Continued)

*Primary Examiner* — Christine J Skubinna
(74) *Attorney, Agent, or Firm* — Sughrue Mion, PLLC

(57) ABSTRACT

The invention relates to a siphon arrangement (1) comprising a housing (2) with an inlet connection piece (3), an outlet connection piece (4), and a siphon seat (5) arranged between the inlet connection piece (3) and outlet connection piece (4), and a siphon element (6) arranged in the siphon seat (5), said siphon element having a siphon portion (7) and an inlet (8) facing towards the inlet connection piece (3) and an outlet (9) leading to the outlet connection piece (4). Water can be guided from the inlet connection piece (3) via the inlet (8) into the siphon portion (7) and from the outlet (9) to the outlet connection piece (4). The siphon element (6) is movable, in particular pivotable, in the housing (2) from a use position into a maintenance position, and when in the maintenance position can be removed, in particular pulled out, from the housing.

18 Claims, 5 Drawing Sheets

(58) Field of Classification Search
USPC ..... 4/679, 681
See application file for complete search history.

(56) References Cited

U.S. PATENT DOCUMENTS

| | | | | |
|---|---|---|---|---|
| 10,655,311 | B1 * | 5/2020 | Murphy | E03C 1/284 |
| 2003/0150051 | A1 * | 8/2003 | Hogger | E03C 1/284<br>4/310 |
| 2011/0115215 | A1 * | 5/2011 | Cronje | E03C 1/284<br>285/129.1 |
| 2020/0063414 | A1 * | 2/2020 | Oberholzer | E03C 1/284 |

FOREIGN PATENT DOCUMENTS

| | | | |
|---|---|---|---|
| EP | 2 256 261 | A2 | 12/2010 |
| EP | 3 260 607 | A1 | 12/2017 |
| EP | 3 260 608 | A1 | 12/2017 |

OTHER PUBLICATIONS

International Search Report for PCT/EP2019/057889 dated Jul. 2, 2019 [PCT/ISA/210].

* cited by examiner

SIPHON

CROSS REFERENCE TO RELATED APPLICATIONS

This application is a National Stage of International Application No. PCT/EP2019/057889, filed on Mar. 28, 2019, which claims priority from European Patent Application No. 18164983.1, filed on Mar. 29, 2018.

TECHNICAL FIELD

The present invention relates to a siphon arrangement according to the preamble of claim 1.

PRIOR ART

From the prior art, siphons serving as stench traps are known. From EP 1 447 486, for instance, a siphon which can be mounted, in particular, beneath a washstand or a sink has been disclosed. A drawback with the siphon according to EP 1 447 486 is that, whenever a siphon is cleaned, the housing part has to be removed and the water lying in the siphon can escape from the housing in an uncontrolled manner. The siphon can thus not be cleaned without the aid of a catch basin.

EP 2 256 261 discloses a siphon which has the same drawbacks as the above-stated siphon.

The configurations of said siphons all have the drawback that the siphons per se are of very complex construction. This not only makes the production difficult, but frequently leads, in particular in connection with the assembly, to seal-tightness problems. In addition, the known siphons have the drawback that, in the disassembly of the siphon, water which lies in the siphon can escape in an uncontrolled manner, which can lead to soiling of the regions outside the siphon.

REPRESENTATION OF THE INVENTION

Starting from this prior art, an object of the invention is to define a siphon which overcomes the drawbacks of the above-stated prior art. In particular, it is an object to define a siphon arrangement which can be cleaned as easily as possible and, in particular, in the course of the cleaning operation, creates no further soiling outside the siphon arrangement.

This object is achieved by a siphon arrangement according to claim 1. According to this, a siphon arrangement comprises a housing having an inlet port, an outlet port and a siphon seat arranged between inlet port and outlet port, and further comprises a siphon element arranged in the siphon seat and having a siphon section, as well as an inlet, which faces the inlet port, and an outlet, which leads to the outlet port. Water can be guided from the inlet port into the siphon section via the inlet, and from the outlet to the outlet port. To the inlet port, a discharge pipe of a sanitary fitting, such as, for instance, of a washstand or of a washbasin, is connectable, and to the outlet port a wastewater conduit is connectable. The siphon element is mounted in the housing so as to be movable from a usage position into a maintenance position, and is removable, in particular extractable, from the housing from the maintenance position along a principal direction via an access opening. The principal direction preferably extends along a straight line. The siphon element is configured such that, in its maintenance position, it is substantially completely emptied. That is to say, no or only an insignificant quantity of residual water is present in the siphon element after the siphon element has been moved from the usage position into the maintenance position. Furthermore, the siphon element and the access opening am configured such that the siphon element is removable from the housing solely when the siphon element lies in its maintenance position. A removal of the siphon element is not possible when the siphon element is outside the maintenance position, thus in the usage position or between the usage position and the maintenance position.

Through the appropriate configuration of the access opening and of the siphon element, it is ensured that the siphon element, at the point of removal from the siphon seat, is substantially completely emptied. With this preferred variant, an uncontrolled escape of water in the event of a cleaning can be largely avoided. That is to say that the described configuration of the siphon element yields the advantage that the water present in the siphon section can flow out of the siphon section in a controlled manner at least partially or wholly via the inlet or the outlet. It is hereby prevented that, during maintenance works, the water can escape in an uncontrolled manner, which will typically lead to a water damage or major cleaning works.

While the inlet is preferably oriented toward the inlet port or is arranged beneath the inlet port, respectively, the outlet lies freely in the siphon seat. The water guided through the siphon element will leave the siphon element via the outlet and flows into the siphon seat, whereupon it is then fed to the outlet port.

Preferably, the siphon element comprises a coding element and the access opening comprises a shape consistent with the coding element. In the maintenance position, the coding element lies relative to the access opening such that the siphon element is removable from the housing. That is to say that the shape of the access opening and the coding element are configured such that a conformity between the shape of the coding element and the shape of the access opening is only achieved when the siphon element is in the maintenance position. The conformity between the two shapes should be understood to mean that the siphon element, in the event of conformity, can be removed from the siphon seat along the principal direction.

The coding element is preferably a mechanical coding element.

The coding element has a shape which preferably substantially corresponds to the clear width of the access opening, when viewed in the principal direction. The coding element can, however, also have a shape which corresponds only partially or in part to the clear width and at other places lies inside the clear width.

Particularly preferredly, the coding element is a flat shield. The outer edges of the shield are preferably complementary to the edges delimiting the access opening.

Preferably, the flat shield, when viewed in the principal direction, extends to in front of the inlet and/or outlet of the siphon element such that the flat shield acts as a splash guard. That is to say that the shield acts as a splash guard with respect to splashes which can escape from the siphon element via the inlet and/or outlet when the siphon element is moved from the usage position into the maintenance position.

The coding element is preferably formed onto the siphon element. That is to say that the coding element and the siphon element are configured in one piece. Alternatively, the coding element is connectable to the siphon element via a mechanical connection.

The access opening is preferably provided by an inside wall of the housing and a panel projecting from the inside wall of the housing. The panel here extends preferably at right angles away from the inside wall of the housing and projects into the interior of the housing. A simple delimitation of the access opening can hereby be achieved.

Particularly preferredly, the panel is arranged in the mouth region of the siphon seat into the outlet port. When viewed in the principal direction, the panel lies such that, upon the movement of the siphon element from the usage position into the maintenance position, escaping water can be fed by the panel to the outlet port.

A further advantage of said panel is that this can likewise form a protection with respect to splashes. That is to say that the panel can be configured such that it prevents an escape of splashes through the access opening during the manipulation of the siphon element. With the panel, there is able to be created, moreover, a type of retaining trough, in the floor of which is arranged the outlet port. The retaining trough is preferably configured such that, in the installation position, the bottommost edge region of the access opening lies at a distance above the retaining trough. The panel further serves as a splash guard once the siphon element is removed and, for instance, is cleaned in the washstand, wherein the water can then flow through the siphon seat.

The siphon arrangement preferably further comprises a cap, which closes off the siphon seat in the region of the access opening, wherein the cap is mounted, in the region of the access opening, on a bearing structure on the housing. The cap hence closes off the siphon seat.

Said bearing structure can be, for instance, a thread or a bayonet lock. Particularly preferredly, an internal thread is arranged on the housing side and an external thread matching the internal thread is arranged on the cap side.

Preferably, between the cap and the housing is provided a seal. With the seal, the connection between mounting element and housing can be tightly sealed with respect to water, so that no water can escape from the housing.

Preferably, the cap comprises an actuating element which is accessible from outside the housing. The actuating element is preferably configured such that this can be comfortably gripped by hand, without the aid of a tool.

Particularly preferredly, the cap acts on the siphon element such that this is held in its usage position when the cap is held in the bearing structure. That is to say that, with the interaction between cap and siphon element, it is achieved that the siphon element is held securely in its usage position. In the mounted position, the cap preferably extends fully over the access opening or the siphon seat, respectively, and closes this off accordingly.

Preferably, the cap and the bearing structure are of substantially circular configuration, wherein the cap is insertable into the bearing structure and can be pivoted accordingly there.

Therein, the cap acts on the siphon element with elements which are arranged on that inner side of the cap which is directed toward the siphon seat.

Particularly preferredly, the cap possesses a mandrel, which engages in an opening on the siphon element, or the siphon element possesses a mandrel, which engages in an opening on the cap, wherein the mandrel and the opening, respectively, are preferably of conical configuration. Through the engagement of the mandrel in the opening, the securement of the siphon element can be achieved.

The opening on the siphon element can be created, for instance, by a wall protruding from said shield.

Preferably, the inlet port on the side of the siphon seat is configured as a branch projecting into the siphon seat, wherein the branch projects into the inlet of the siphon element when the siphon element is in the usage position. That is to say that, upon the movement from the usage position, the siphon element is moved, in a corresponding first step, in the direction of orientation of the branch. After this, preferably a rotation or pivoting of the siphon element into the maintenance position follows, out of which the siphon element can then be removed from the siphon seat in the direction of said principal direction.

In the region of the inlet into the siphon element, preferably a seal element is arranged. Here, the seal element can be arranged either on said port or in the region of the inlet on the siphon element.

Preferably, at least one guide structure is arranged between siphon seat and siphon element. The at least one guide structure is configured such that the siphon element, upon the movement from the usage position into the maintenance position, is firstly guided along a vertical movement, wherein, after a completed separation between inlet port or port, respectively, and siphon element, the siphon element is pivotable into the maintenance position about a pivot axis oriented parallel to the principal direction.

The guide structure preferably has a first guide surface and an abutting second guide surface, wherein the first guide surface is fixedly arranged in the siphon seat and runs in the direction of the center axis of the inlet port or of the branch, respectively, and wherein the second guide surface is fixedly arranged on the siphon element and slides away from the inlet port upon the movement into the maintenance position and along the first guide surface.

The guide structure preferably further has a stop, against which the siphon element abuts when lying in the maintenance position.

Particularly preferredly, the siphon element is pivotable through an angle of no more than 120°. Depending on the configuration of the siphon element, the angle can also be less than 120°, which has the advantage that not all elements lying in the siphon section, such as, for instance, a piece of jewelry, can be emptied out of the siphon section upon the movement of the siphon element.

Preferably, the inlet, upon the movement into the maintenance position, is moved toward the outlet port, wherein the inlet then lies lower than the outlet. The water lying in the siphon section can then completely or at least partially escape from the siphon element through the inlet and flows off via the outlet port. A reverse rotation is also possible.

The siphon element preferably has the form of a curved pipe. The configuration of the siphon element as a siphon element removable from the housing and as a p-trap yields the advantage that the siphon element is easy to clean and has good flow through values.

Furthermore, through the configuration of the siphon as a curved pipe, a particularly simple structure can be created. Moreover, this configuration has the advantage that complex seals are no longer necessary.

A "curved pipe" is understood as a pipe which is curved such that it forms a stench trap. The curved pipe is curved, for instance, in a U-shape. The "curved pipe" can also be referred to as an elbow siphon, an elbow stench trap or a p-trap. The configuration of the siphon element as a curved pipe further has the advantage that the siphon can act as a type of vessel. That is to say that any residual water which might be present in the siphon cannot flow out of the siphon section during the removal of the siphon element. Moreover, the configuration of the siphon element as a curved pipe has the advantage that standing water is always only in the curved pipe, which, with respect to seals which are to be arranged from the prior art, is advantageous in terms of the load on the seals.

Preferably, the cross section of the pipe is oval or elliptical or circular. The cross section of the inlet port is preferably circular, wherein, via the seal, an adaptation of the cross section to the pipe can be made. Preferably, the cross section of the pipe is substantially constant throughout the entire pipe length.

Preferably, a panel surrounds the pipe substantially completely, apart from the inlet and the outlet. In other words, the pipe is configured as a duct which is closed all the way round.

Preferably, the inlet lies, in the usage position, substantially higher than or at the same height as the outlet. Viewed from the inlet, the siphon element here extends downward in the direction of gravity and then back up again to the outlet.

In the usage position, the inlet of the siphon element is located directly beneath the inlet port, so that the entire quantity of water can be fed to the siphon.

Preferably, the siphon arrangement has a retaining chamber, which is configured such that an object which is present in the pipe of the siphon element, such as an object of value, upon a rotation from the usage position into the maintenance position, can fall into the retaining chamber. Particularly preferably, the retaining chamber is integrated on the siphon element and extends, in the region of the outlet and/or inlet, outward from the siphon panel, wherein the retaining chamber is configured such that an object present in the pipe, such as an object of value, upon a rotation from the usage position into the maintenance position, can fall into the retaining chamber. Consequently, following removal of the siphon element from the siphon seat, the user can remove the article from the retaining chamber. It is hereby prevented that, during the movement from the usage position into the maintenance position, the article falls out of the siphon element in the direction of the outlet port.

Alternatively, the retaining chamber can also be arranged in the siphon seat.

Preferably, the outlet port is arranged relative to the inlet port such that water flows from the inlet port into the outlet port when the siphon element is not inserted. This is advantageous if, when the siphon element is not inserted, water makes its way into the siphon arrangement via the inlet. This water will then flow through the siphon arrangement and leave it through the outlet port, so that water damage can be largely prevented.

Preferably, when viewed in the installation position, the inlet from the siphon seat into the outlet port lies lower than the access opening.

Further embodiments are defined in the dependent claims.

BRIEF DESCRIPTION OF THE DRAWINGS

Preferred embodiments of the invention are described below with reference to the drawings, which serve merely for illustrative purposes and should not be interpreted restrictively. In the drawings.

DESCRIPTION OF PREFERRED EMBODIMENTS

Figure 1:
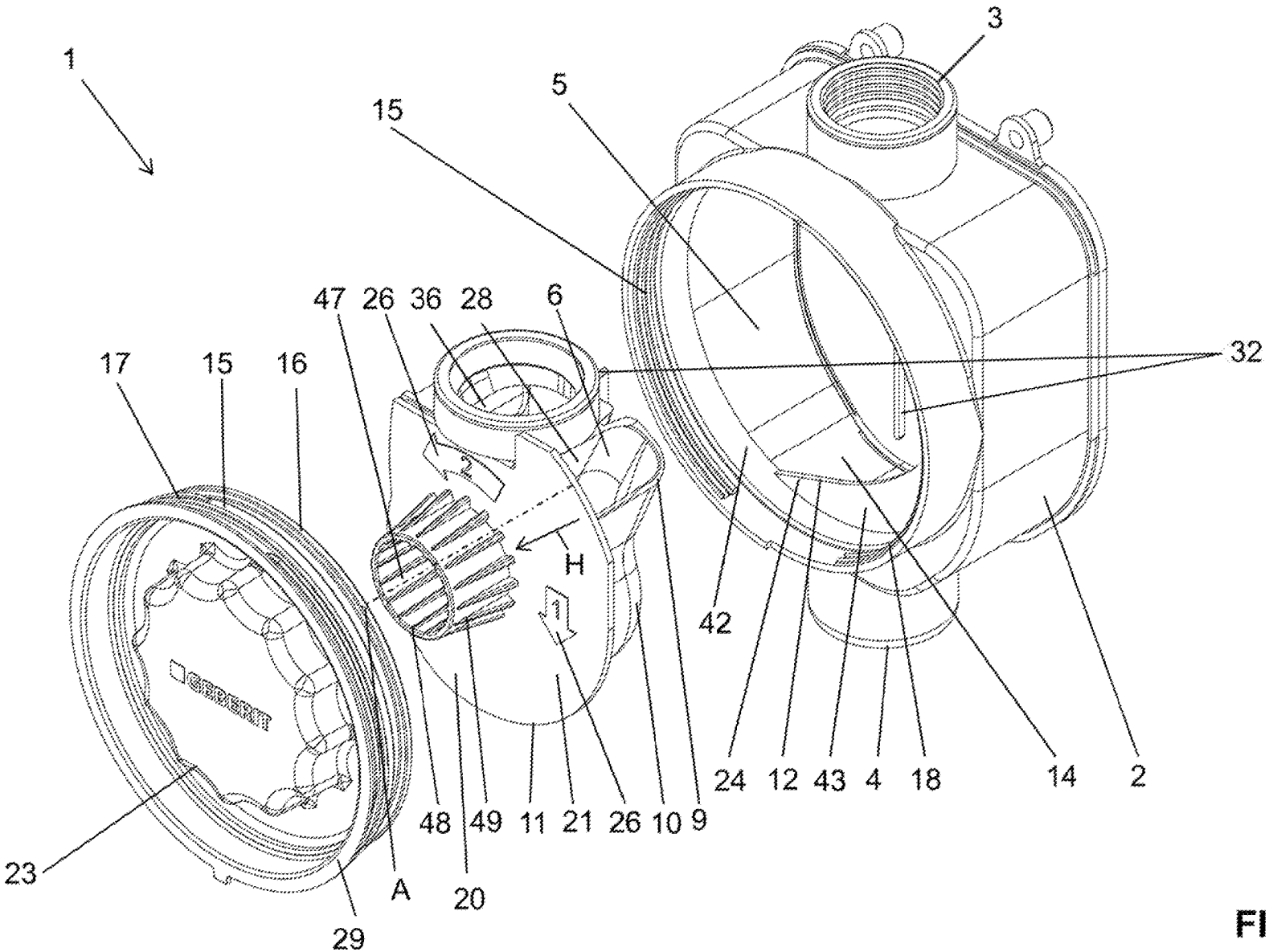
FIG. 1 shows a perspective exploded view of a siphon arrangement having a siphon element according to one embodiment of the present invention.

In the figures, a siphon arrangement 1 according to one embodiment of the present invention is shown. The siphon arrangement 1 comprises a housing 2 having an inlet port 3, an outlet port 4, and also a siphon seat 5 arranged between inlet port 3 and outlet port 4. The siphon arrangement 1 further comprises a siphon element 6 arranged or mounted, respectively, in the siphon seat 5 and having a siphon section 7, and also having an inlet 8 facing the inlet port 3, and an outlet 9 leading to the outlet port 4. The siphon section 7 acts as a stench trap. Water is guided from the inlet port 3, via the inlet 8, into the siphon section 7, then passes through the siphon section 7, and can then be led away from the siphon section 7, via the outlet 9, to the outlet port 4. The water flows through the siphon section 7. In FIG. 4*a*, the flow direction of the water is marked with a dashed line F. The siphon element 6 can be inserted into the siphon seat 5 via an access opening 24 and removed from the siphon seat 5.

Figure 4C:
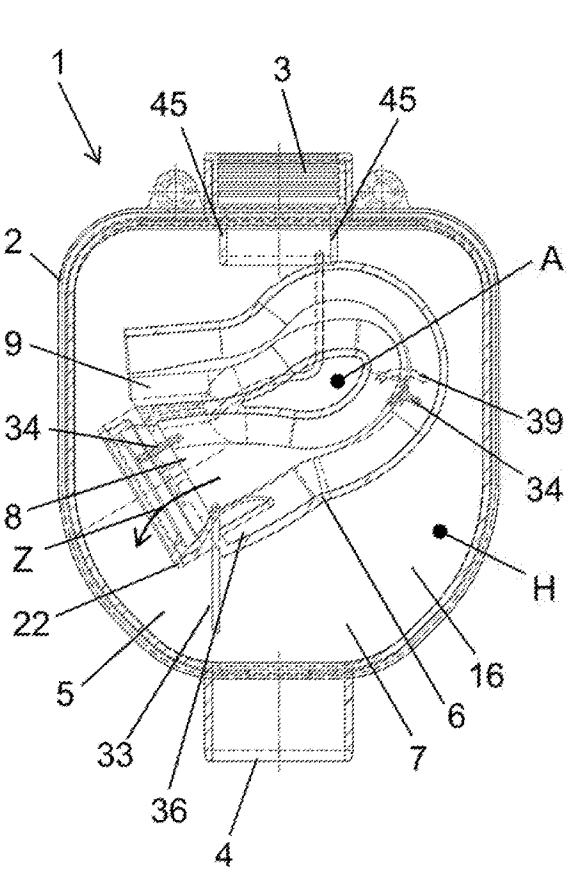
FIG. 4*a*-4*c* show sectional representations of the siphon arrangement according to FIG. 1, wherein the siphon element is shown at different positions.
Figure 4B:
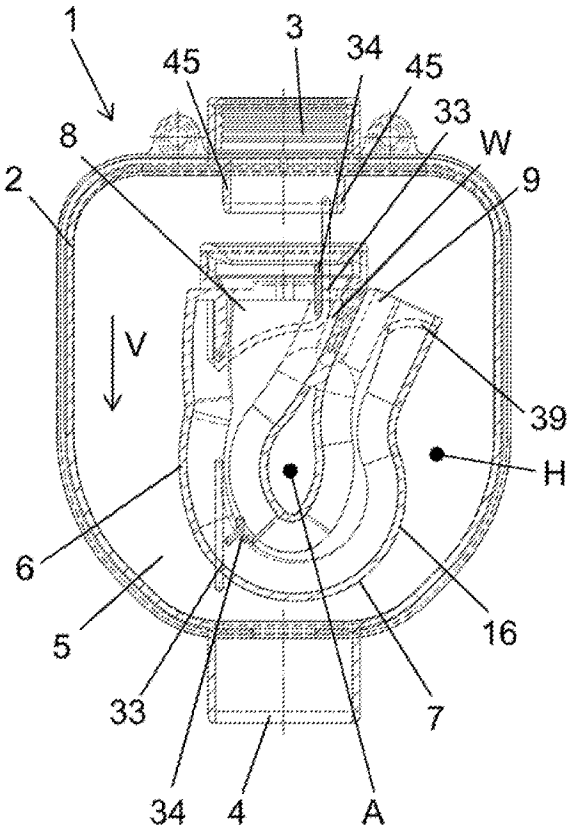
Figure 4A:
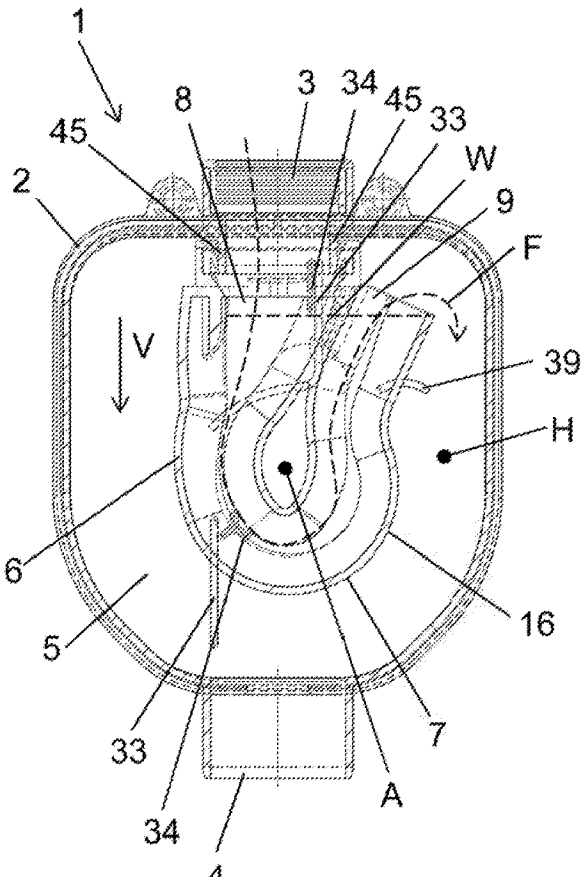

The siphon element 6 is mounted in the siphon seat 5 in the housing 2 so as to be movable from a usage position, as is shown in FIG. 4*a*, into a maintenance position, as shown in FIG. 4*c*. In the shown embodiment, the siphon element 6 is able to firstly be pivoted along a vertical direction V, and subsequently about a pivot axis A. The pivot angle can be up to 120°. From the maintenance position, the siphon element 6 can be removed from the housing 2. In the shown embodiment, it is extracted from the siphon seat 5 along the pivot axis A in the direction of a principal direction H, via the access opening 24.

Figure 3C:
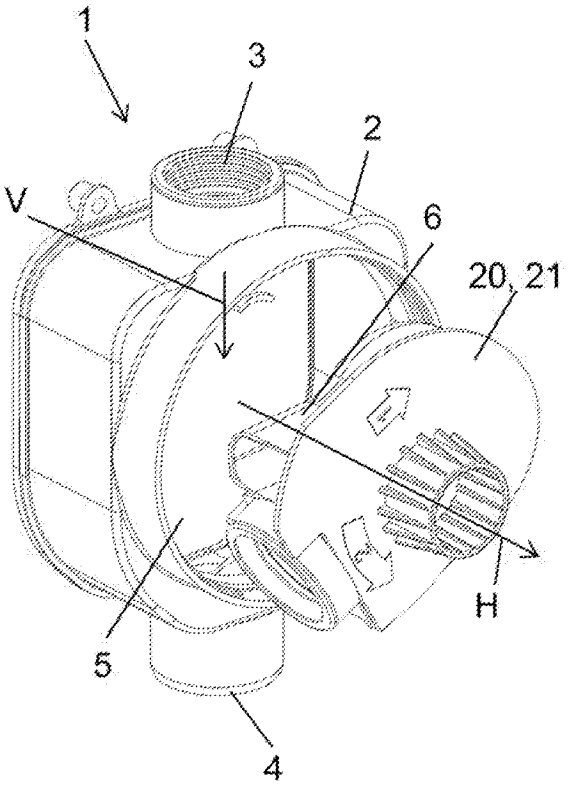
FIG. 3*a*-3*c* show different representations of the siphon arrangement according to FIG. 1, wherein the siphon element is shown at different positions.
Figure 3B:
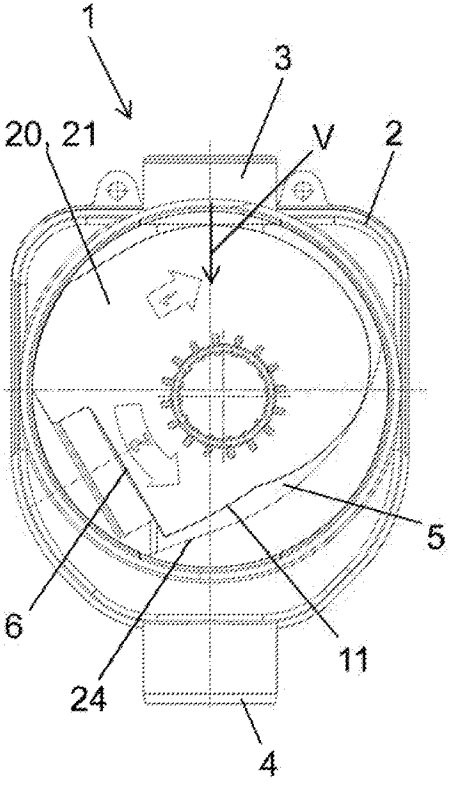
Figure 3A:
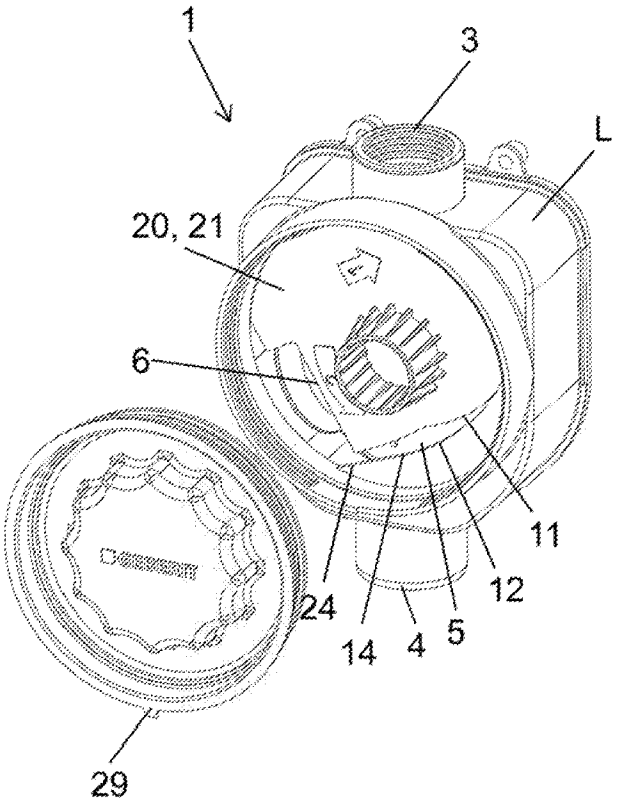

In FIGS. 3*a* and 3*b*, the siphon element 6 is shown in the maintenance position. The siphon element 6 is configured such that, in its maintenance position, it is substantially completely emptied. That is to say that no residual water, or only an insignificant quantity of residual water, is still present in the siphon element 6.

The siphon element 6 and the access opening 24 are configured such that the siphon element 6 is removable from the housing 2 solely when the siphon element 6 lies in its maintenance position. That is to say that the siphon element 6 is not removable from the housing 2 when the siphon element lies in its usage position or a position between the usage position and the assembly position.

In the shown embodiment, the siphon element 6 has a coding element 20 and the access opening 24 has a shape conforming to or matching the coding element 20, respectively.

During the removal of the siphon element 6, the coding element 20 must lie relative to the shape of the access opening 24 such that the siphon element 6 is removable. The correct position is shown in FIGS. 3*a* and 3*b*. From these figures it can be clearly seen that the rim 11 of the coding element 20 lies in such away relative to the rim 12 of the access opening 24 that the siphon element 6 is correspondingly removable from the siphon seat 5. Preferably, a slight clearance is present between the rims 11 and 12.

In FIG. 3*c*, it is then shown how the siphon element is removable from the siphon seat 5 along the principal direction H.

Figure 2:
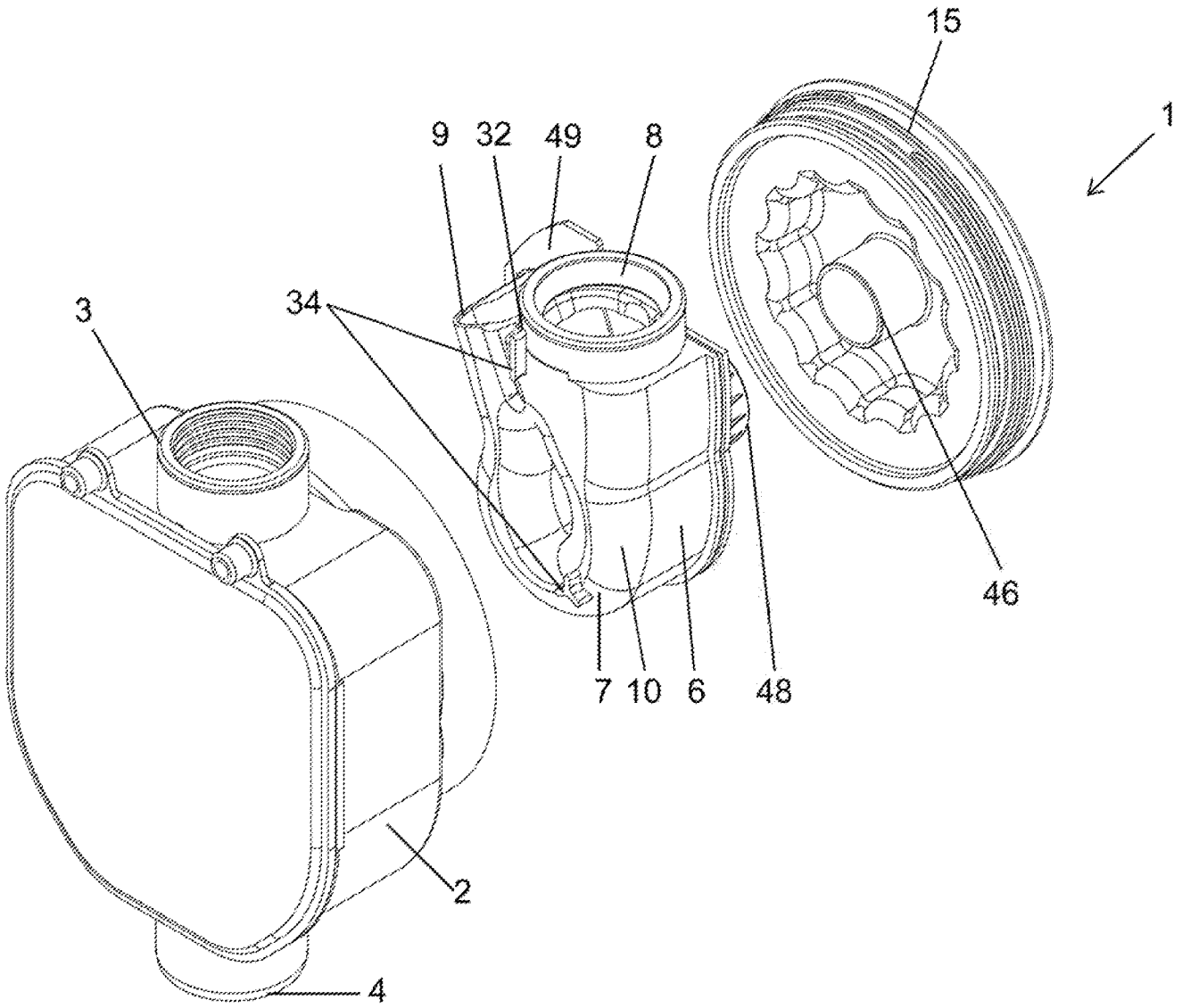
FIG. 2 shows a further perspective exploded view of the siphon arrangement according to FIG. 1.

In the presently shown embodiment, the coding element 20 has the shape of a flat shield 21. The flat shield 21 is formed onto the tubular siphon element 6 here. The shield 21 is configured here such that it extends to in front of the outlet 9 of the siphon element 6 such that the flat shield 21 acts as a splash guard. This can be clearly seen in FIG. 2. During the manipulation of the siphon element 6, any splashes out of the outlet 9 can be intercepted by the rear part of the shield 21. The rear part bears the reference numeral 13.

The coding element 20 or the shield 21, respectively, can be fixedly formed onto the siphon element 6, or can be connected to the siphon element 6 via a mechanical connection.

The access opening 24 is provided by an inside wall 42 of the housing 2 and by a panel 43 projecting from the inside wall 42 of the housing. The panel 43 is shown clearly in FIGS. 1, 3*a*, 3*b*. The panel 43 is arranged here with respect to the outlet port 4 such that, in the region of the mouth between siphon seat 5 and outlet port 4, a retaining trough 14 is created. The retaining trough 14 has the advantage of ensuring that the water cannot flow off via the access opening 24 when the access opening 24 is open.

The siphon arrangement 1 further comprises a cap 29. As shown in the figures, the cap 29 closes off the siphon seat 5 in the region of the access opening 24. The cap 29 is mounted in the region of the access opening 24 on a bearing structure 15 on the housing 2. The bearing structure is here provided by an external thread 17 on the cap and an internal thread 18 in the region of the access opening 24. The internal thread 18 is arranged in front of the access opening 24 and the siphon seat 5 lies behind the access opening 24. Between the cap and the housing 2 a seal 16 is arranged.

Figure 5:
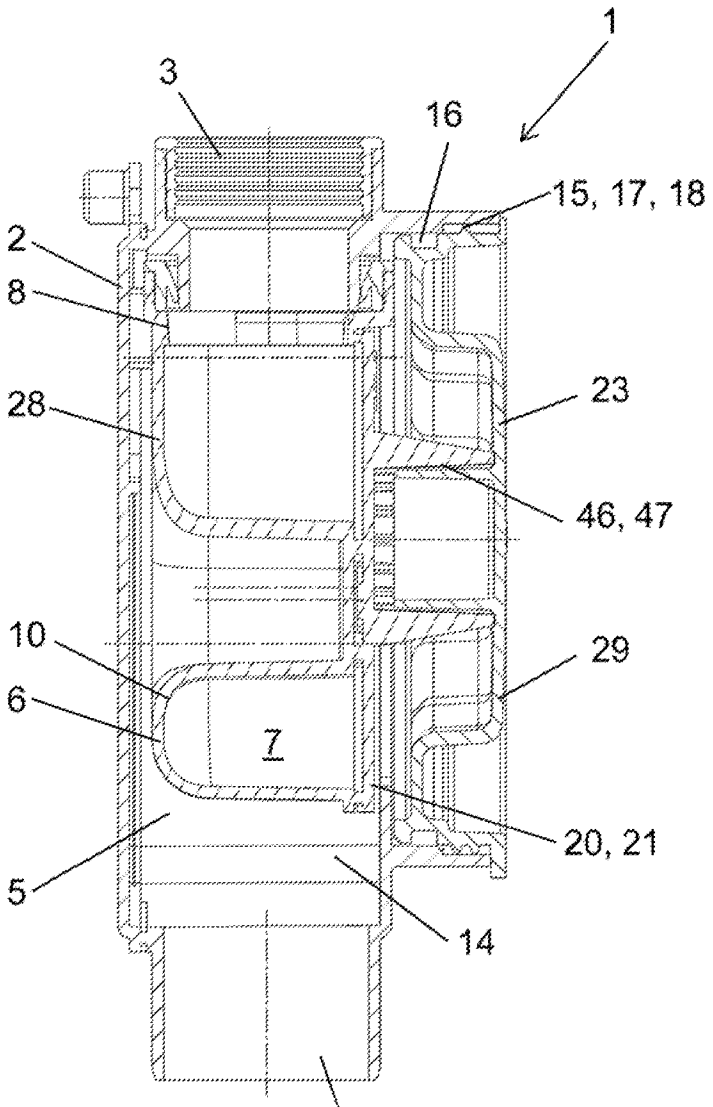
FIG. 5 shows a further sectional representation.

The cap 29 acts on the siphon element such that this is held in its usage position when the cap 29 is held in the bearing structure 15. In the shown variant, protruding from the rear side of the cap 29 is a mandrel 46, which engages in an opening 47 arranged on the siphon element 6. The mandrel 46 and the opening 47 are clearly apparent from FIGS. 1 and 2. In FIG. 5, the engagement of the mandrel 46 in the opening 47 is then shown. The mandrel 46 and the opening 47 are preferably of slightly conical configuration, so that a good cantering of the siphon element 6 can be achieved.

The opening 47 is here formed by a panel 48 which protrudes from the coding element 20. In the shown embodiment, the panel 48 is reinforced by ribs 49.

On the outside, the cap has an actuating element 23, which can be comfortably gripped by a user.

In the shown embodiment, the inlet port 3 on the side of the siphon seat 5 is configured as a branch 45 projecting into the siphon seat 5. The branch 45 projects into the inlet 8 of the siphon element 6 when the siphon element 6 is in the usage position. This is shown in FIGS. 4*a* and 4*b*. During a movement from the usage position into the maintenance position, the siphon element is first moved in the vertical direction V and can subsequently, after separation between branch 45 and siphon element 6 has taken place, be accordingly pivoted. This is signaled to the user by the two pictograms 26 on the front side of the shield 21.

In order to aid the movement of the siphon element 6 in the siphon seat, a guide structure 32 is arranged between the siphon seat 5 and the siphon element 6. In FIGS. 4*a* to 4*c*, the guide structure is represented. The guide structure 32 comprises a plurality of elements and is configured such that the siphon element 6, during the movement from the usage position into the maintenance position, is first guided along a vertical movement V, wherein, after separation between inlet port 3 or branch 45, respectively, and siphon element 6 has taken place, the siphon element 6 can be pivoted into the maintenance position about a pivot axis A oriented parallel to the principal direction H.

The guide structure 32 has a first guide surface 33 and an abutting second guide surface 34. The first guide surface 33 is fixedly arranged in the siphon seat 5 and is oriented in the direction of the center axis of the inlet port 3 or of the branch 45, respectively. The second guide surface 34 is fixedly arranged on the siphon element 6 and, upon the movement into the maintenance position along the first guide surface 33, slides away from the inlet port 3. This movement is represented in FIGS. 4*a* and 4*b*. In the shown embodiment, two first guide surfaces 33 and two second guide surfaces 34 are arranged.

The guide structure 32 further comprises a stop 39, which is arranged in the siphon seat 5. When the siphon element 6 is lying in the maintenance position, it abuts against the stop. This is shown in FIG. 4*c*. In FIG. 4*c*, the siphon element 6 is located in the same position as in FIG. 3*b*, namely in the maintenance position.

Following below are some further comments on the preferred embodiment shown in the figures.

The siphon element 6 has the form of a curved pipe 28. The pipe 28 here extends from the inlet 8 to the outlet 9. The pipe 28 is generally of U-shaped configuration, wherein the pipe 28 runs laterally before and after the actual siphon section 7 slightly outward, so that sort of a bulging U-shape is formed.

In the shown embodiment, the cross section of the pipe 28 of the siphon element is of oval or elliptical configuration, respectively. Throughout the pipe length, the cross section of the pipe 28 is substantially constant. The pipe 28 is surrounded by a siphon panel 10. The cross section of the pipe 28 can also be circular. In the shown embodiment, an oval structure was chosen, because this is advantageous in terms of the spatial relationships and the compactness of the siphon element 6.

In all figures it can clearly be seen that, in the region of the inlet 8, a retaining chamber 36 extends outward on the siphon panel 10. This retaining chamber 36 is advantageous during the movement of the siphon element 6 into the maintenance position, and this is shown in FIG. 4. An object, for instance an object of value, present in the bottommost region of the siphon element 6, can fall into the retaining chamber 36 during the rotation of the siphon element from the usage position into the maintenance position. That is to say that the object is retained in the retaining chamber 36 and is not emptied out via the inlet 8. In this respect, the object can be prevented from moving in the direction of the outlet port 4, and thus in the direction of the wastewater system.

In FIG. 4*a* it is shown that the siphon element 6 is configured such that, upon a movement of the siphon element 6, the water lying in the siphon section 7 flows at least in part to the outlet port 4. In FIG. 4*a*, the water lying in the siphon section 7 is symbolized with a dashed line W. In FIG. 5, the siphon element 6 is shown in the usage position. The siphon section 7 is here filled with water up to the line W which runs through the inlet 8 and the outlet 9. If now the siphon element 6 is pivoted from the usage position into the maintenance position, then the water lying in the siphon section 7 can flow off in the direction of the outlet port 4 via the inlet 8. This is symbolized in FIG. 4*c* by the arrow Z. The water thus flows over the edge having the reference numeral 22, which edge delimits the inlet 8 in the direction of the outlet port 4.

Furthermore, the siphon element 6 is configured such that any residual water in the siphon section 7, during the removal of the siphon element 6, cannot flow out of the siphon section 7. That is to say that the siphon section 7 is configured as a type of "cup", wherein the water then remains in this "cup". In the shown embodiment, the siphon section 7 is delimited by a panel 10. The panel 10 surrounds the siphon section 7 substantially completely, apart from the inlet 8 and outlet 9. The siphon section 7 is thus configured by the panel 10 as a duct which is closed all the way round, whereby the aforementioned "cup" can be provided.

In the usage position, the inlet 8 of the siphon section 7 lies slightly higher than the outlet 9.

REFERENCE SYMBOL LIST

| | |
|---|---|
| 1 | siphon arrangement |
| 2 | housing |
| 3 | inlet port |
| 4 | outlet port |
| 5 | siphon seat |
| 6 | siphon element |
| 7 | siphon section |
| 8 | inlet |
| 9 | outlet |
| 10 | siphon panel |
| 11 | rim |
| 12 | rim |
| 13 | rear part |
| 14 | retaining trough |
| 15 | bearing structure |
| 16 | seal |
| 17 | external thread |
| 18 | internal thread |
| 20 | coding element |
| 21 | shield |
| 22 | edge |
| 23 | actuating element |
| 24 | access opening |
| 26 | pictogram |
| 28 | pipe |
| 29 | cap |
| 32 | guide structure |
| 33 | first guide surface |
| 34 | second guide surface |
| 36 | retaining chamber |
| 39 | stop |
| 42 | inside wall |
| 43 | panel |
| 45 | branch |
| 46 | mandrel |
| 47 | opening |
| 48 | panel |
| 49 | ribs |
| A | pivot axis |
| W | water level |
| Z | arrow |
| F | flow direction |
| V | vertical movement |
| H | principal direction |

The invention claimed is:

1. A siphon arrangement comprising:

a housing comprising an inlet port, an outlet port and a siphon seat arranged between inlet port and outlet port, and a siphon element arranged in the siphon seat and comprising a siphon section, as well as an inlet, which faces the inlet port, and an outlet, which opens out into the siphon seat, wherein water can be guided from the inlet port into the siphon section via the inlet, and from the outlet into the siphon seat, and subsequently to the outlet port, wherein the siphon element is mounted in the housing so as to be movable from a usage position into a maintenance position, and is removable, or extractable, from the housing from the maintenance position along a principal direction via an access opening, wherein the siphon element is configured such that, in its maintenance position, it is substantially completely emptied, and wherein the siphon element and the access opening are configured such that the siphon element is removable from the housing solely when the siphon element lies in its maintenance position.

2. The siphon arrangement as claimed in claim 1, wherein the siphon element comprises a coding element, and wherein the access opening has a shape consistent with the coding element, wherein, in the maintenance position, the coding element lies relative to the access opening such that the siphon element is removable from the housing.

3. The siphon arrangement as claimed in claim 2, wherein the coding element is a flat shield, which, when viewed in the principal direction, preferably extends to in front of the inlet and/or the outlet of the siphon element such that the flat shield acts as a splash guard.

4. The siphon arrangement as claimed in claim 2, wherein the coding element is fixedly formed onto the siphon element or is connectable to the siphon element via a mechanical connection.

5. The siphon arrangement as claimed in claim 3, wherein the coding element is fixedly formed onto the siphon element or is connectable to the siphon element via a mechanical connection.

6. The siphon arrangement as claimed in claim 1, wherein the access opening is provided by an inside wall of the housing and by a panel projecting from the inside wall of the housing.

7. The siphon arrangement as claimed in claim 6, wherein the panel is arranged in the mouth region of the siphon seat into the outlet port, wherein, when viewed in the principal direction, the panel lies such that, during the movement of the siphon element from the usage position into the maintenance position, escaping water can be guided from the panel to the outlet port.

8. The siphon arrangement as claimed in claim 1, wherein the siphon arrangement further comprises a cap, which closes off the siphon seat in a region of the access opening, and wherein the cap is mounted, in the region of the access opening, on a bearing structure on the housing.

9. The siphon arrangement as claimed in claim 8, wherein the cap acts on the siphon element such that it is held in its usage position when the cap is held in the bearing structure.

10. The siphon arrangement as claimed in claim 8, wherein the cap possesses a mandrel, which engages in an opening on the siphon element, or wherein the siphon element possesses a mandrel, which engages in an opening on the cap.

11. The siphon arrangement as claimed in claim 1, wherein the inlet port on the side of the siphon seat is configured as a branch projecting into the siphon seat, and wherein the branch projects into the inlet of the siphon element when the siphon element is in the usage position.

12. The siphon arrangement as claimed in claim 11, wherein in a region of the inlet a seal element is arranged.

13. The siphon arrangement as claimed in claim 1, wherein at least one guide structure is arranged between the siphon seat and the siphon element, which at least one guide structure is configured such that the siphon element, during the movement from the usage position into the maintenance position, is first guided along a vertical movement, and wherein, after separation between inlet port or branch, respectively, and the siphon element has taken place, the siphon element is pivotable into the maintenance position about a pivot axis oriented parallel to the principal direction.

14. The siphon arrangement as claimed in claim 13, wherein the guide structure comprises a first guide surface and an abutting second guide surface, wherein the first guide surface is fixedly arranged in the siphon seat and runs in the direction of a center axis of the inlet port or of the branch, respectively, and wherein the second guide surface is fixedly arranged on the siphon element and, upon the movement into the maintenance position and along the first guide surface, slides away from the inlet port.

15. The siphon arrangement as claimed in claim 13, wherein the guide structure further has a stop against which the siphon element abuts when the siphon element is lying in the maintenance position.

16. The siphon arrangement as claimed in claim 14, wherein the guide structure further has a stop against which the siphon element abuts when the siphon element is lying in the maintenance position.

17. The siphon arrangement as claimed in claim 1, wherein the siphon element has the form of a curved pipe.

18. The siphon arrangement as claimed in claim 10, wherein the mandrel or the opening, respectively, are of conical configuration.

* * * * *